US006312365B1

(12) United States Patent
Koenig

(10) Patent No.: US 6,312,365 B1
(45) Date of Patent: Nov. 6, 2001

(54) EXERCISE APPARATUS FOR LEG MUSCLES

(75) Inventor: Larry D. Koenig, Williamsburg, IA (US)

(73) Assignee: M'N Fitness Corp., Altus, OK (US)

( * ) Notice: Subject to any disclaimer, the term of this patent is extended or adjusted under 35 U.S.C. 154(b) by 0 days.

(21) Appl. No.: 09/539,173

(22) Filed: Mar. 30, 2000

(51) Int. Cl.[7] ..... A63B 21/08
(52) U.S. Cl. ..... 482/97; 482/93
(58) Field of Search ..... 482/92, 93, 95, 482/97–100, 104, 135–137, 133, 140, 145, 79, 80

(56) References Cited

U.S. PATENT DOCUMENTS

| | | | | |
|---|---|---|---|---|
| 4,270,749 | * | 6/1981 | Hebern | 272/96 |
| 4,357,010 | * | 11/1982 | Telle | 272/117 |
| 4,828,254 | * | 5/1989 | Maag . | |
| 5,201,694 | * | 4/1993 | Zappel | 482/133 |
| 5,529,558 | * | 6/1996 | Koenig | 482/97 |
| 5,702,328 | * | 12/1997 | Mansvelt | 482/96 |
| 5,711,749 | * | 1/1998 | Miller | 482/135 |

OTHER PUBLICATIONS

Hammer Strength Rowing/Seated Shrug, Hammer: First In Strength, Hammer Strength brochure, p. 11, circa 1994.
Advertising brochure: "PTS Personal Training System by Pro Industries", Pro Industries, 1015 N. Hurricane Road, Franklin, IN 46131.
Advertising brochure: "Hammer Strength Product Information Guide", Hammer Strength, P.O. Box 19040, Cincinnati, OH 45219.
Advertising brochure: Badger Magnum Strength Systems, 1010 Davis Avenue, South Milwaukee, WI 53172.
"She's Got Legs", *Muscle and Fitness*, Apr. 1996, pp. 131–137.

* cited by examiner

*Primary Examiner*—Justine R. Yu
(74) *Attorney, Agent, or Firm*—Allan L. Harms

(57) ABSTRACT

Exercise apparatus for the calf muscles of the legs includes a foot platform which may rock forward and rearward on the base of the apparatus. A lateral arm is supported above the base and has spaced shoulder engagement arms which overlie the foot platform. The lateral arm is raised and lowered by the action of a user rocking back and forth on the foot platform. The lateral arm is linked to a weight arm which is raised and lowered with the movement of the lateral arm. Free circular weight plates can be suspended on the weight arms.

17 Claims, 3 Drawing Sheets

EXERCISE APPARATUS FOR LEG MUSCLES

BACKGROUND OF THE INVENTION

Various methods and apparatus exist to strengthen leg muscles, especially the muscles of the calf. Generally these devices have a common feature, namely the raising of the heels from a flat surface. The exercise can be done while carrying a barbell or other free weights, or it can be carried out by lifting some weighted apparatus while lifting the heels from a standing position. The lifting of the heels to a position standing on the balls and toes of the feet necessarily creates a tendency to instability, especially if free weights are being carried and additional balance challenges are thereby presented. A safe and effective apparatus to allow the exercise of the calf muscles in a stable position would be a salutary development.

SUMMARY OF THE INVENTION

The invention disclosed provides an effective and safe to operate exercise apparatus for strengthening the muscles of the legs, particularly the calf muscles. A base is equipped with a rocking foot platform which is pivotable from front to rear about a central pivot axis oriented transversely to the longitudinal axis of the base. An upright support member is mounted on the base at an opposing end of the base from the foot platform. At the upper end of this fixed upright member is a hinge to which is mounted a lateral arm which terminates in a pair of shoulder engagement bars which are padded and separated such that a user's head and neck will fit between the separated shoulder engagement bars. The shoulder engagement bars are positioned above the foot platform. A weight arm is also hinged to the upright support member below the lateral arm so that it can pivot vertically in alignment with the lateral arm. At the end of the weight arm opposing its hinged connection to the upright support member there is a transverse weight support rod which is centered on the end of the weight arm. An adjustable link member interconnects the lateral arm and the weight arm. The link member is adjustable lengthwise and is hinged at each of its ends. The link member is hinged to the lateral arm about midway between the hinge of the lateral arm to the upright support and the shoulder engagement bars. The link member is hinged to the weight arm approximately one-third of the distance along the weight arm measured from its hinge mounting to the weight support member. Free weights can be added to the weight support rod on either side of the weight arm and preferably symmetrically. A weight arm support member is mounted to the base under the weight support to provide a lower rest support for the weight arm. An inclined stabilizer arm interconnects the weight arm support member and the upright support member.

In practice, the user may stand on the floor behind the foot platform on the base and place his head and neck between the shoulder engagement bars. The link member is then adjusted for the user's height such that the weight arm rests on the weight arm support member with the shoulder engagement bars resting on the user's shoulders. The user may then step forward onto the foot platform, raising the lateral arm and the weight arm as the user mounts the apparatus. As the user rocks back on the heels, the weight is lowered almost into contact with the weight arm support member. As the user rocks forward, the weight arm is raised as the user forces the lateral arm upward with his shoulders. Handles are mounted to either side of the lateral arm so that the user has a structure to grip while the exercise is done.

Once the desired repetitions of the exercise have been completed, the user may crouch slightly to rest the weight arm on the weight arm support member and dismount the exercise apparatus.

It is accordingly an object of the invention to provide a stable exercise apparatus for safe exercise of the calf muscles of the legs.

It is a further object of the invention to provide an effective calf exercise apparatus which is adjustable for many different sizes of users.

It is also an object of the invention to provide calf exercise apparatus which can utilize free weights to provide appropriate loading to challenge the strength of the user.

It is a further object of the invention to provide an exercise apparatus which allows the user to rock his feet forward to raise the heels without lifting the heels off a support surface.

These and other objects of the invention will be better understood from examination of the detailed description and the drawings.

DESCRIPTION OF THE DRAWING FIGURES

DETAILED DESCRIPTION OF THE INVENTION

Figure 1:
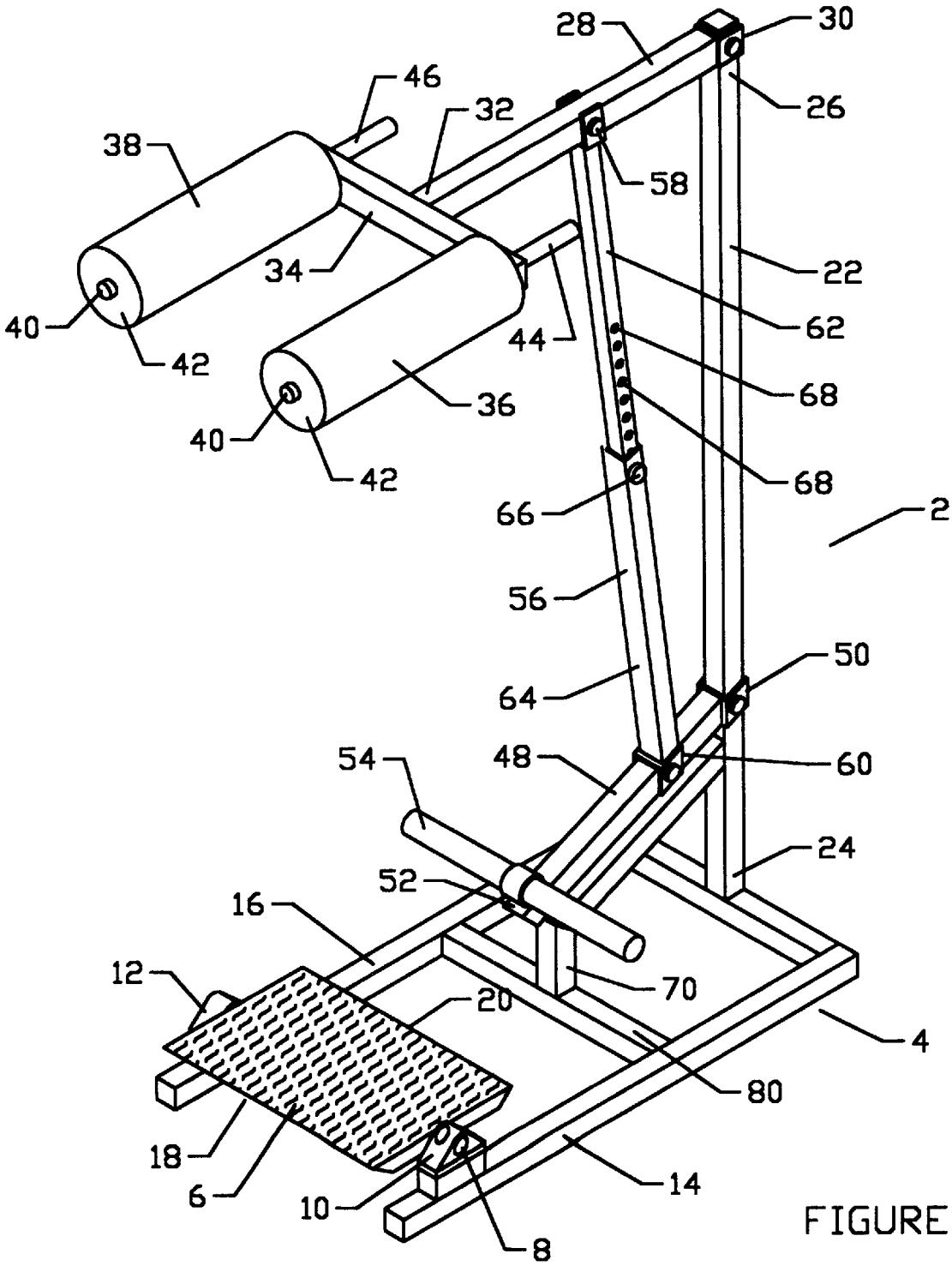
FIG. 1 is a front right perspective view of the preferred embodiment of the invention in a rest position.

Referring to the figures, it is seen that the invention 2 comprises a base frame 4 to which is mounted a foot platform 6. Foot platform 6 is mounted pivotally to base frame 4 upon a transverse pivot axle 8. Pivot axle 8 is journally supported in bearings 10, 12 mounted upon opposing sides 14, 16 of base 4. Pivot axle 8 supports foot platform 6 about equidistant from front edge 20 and rear edge 18 of foot platform 6.

Spaced from foot platform 6 on base 4 is upright support member 22 which is fixed at its lower end 24 to base 4. Upright support member 22 is an elongate substantially vertical bar with an upper end 26 at which is pivotally mounted an elongate lateral arm 28 which extends over base 4. Lateral arm 28 pivots in a vertical plane around first hinge 30.

Free end 32 of lateral arm 28 is provided with a cross bar 34 perpendicularly mounted thereto, the axis of cross bar 34 being substantially horizontal. Mounted to cross bar 34 in a spaced apart relationship are shoulder engagement arms 36, 38 which each extend from cross bar 34 generally in parallel to the axis of lateral arm 28. Preferably shoulder engagement arms 36 and 38 are centered upon lateral arm 28 and lateral arm 28 is of sufficient length that shoulder engagement arm 36 and 38 will overlie foot platform 6. Shoulder engagement arms 36, 38 preferably comprise elongate spines 40 with compressible padded sleeves 42 annularly surrounding spines 40 along the lengths thereof. Spines 40 may extend through cross bar 34 and extend therefrom toward upright support member 22 providing co-parallel handgrips 44 and 46 spaced apart from lateral arm 28 at equal distances.

Mounted to upright support member 22 substantially below lateral arm 28 is weight arm 48 which is pivotally retained by second hinge 50 to upright support member 22. Weight arm 48 is pivotally vertically in a plane coincident with the plane of pivot of lateral arm 28. Mounted at or adjacent free end 52 of weight arm 48 is weight receiving rod 54 which is centered on weight arm 48 and substantially perpendicularly thereto.

Interconnecting lateral arm 28 and weight arm 48 is link member 56 which is elongate and selectively variable in length. Link member 56 is hingedly connected to lateral arm 28 by third hinge 58 and it is hingedly connected to weight arm 48 by fourth hinge 60. The motion of pivot of link member 56 is within the plane defined by lateral arm 28 and weight arm 48. Link member 56 is longitudinally extendable by sliding upper bar 62 within tube 64, securing them at a desired extension by use of pin 66 which is selectively insertable in one of holes 68 of upper bar 62.

Link member 56 is hinged to lateral arm 28 at approximately its midpoint while link member 56 is hinged to weight arm approximately one-third of the distance along weight arm 48 from second hinge 50 to weight receiving rod 54.

Disposed below and vertically aligned with weight arm 48 is weight arm rest support 70 which in the preferred embodiment comprises a generally vertical leg 72 connected to an inclined stabilizer bar 74 joined to upright support 22 at a position below second hinge 50. Preferably stabilizer bar 74 is disposed in parallel to weight arm 48 when weight arm 48 rests on weight arm rest support 70. Complementary resilient bumpers 76 and 78 may be mounted to weight arm rest support 70 and weight arm 48 respectively such that the resilient bumpers 76 and 78 will abut when weight arm 48 rests upon weight arm rest support 70. Leg 72 of weight arm rest support 70 is supported on a frame cross member 80 which interconnects sides 14 and 16 of base frame 4 generally midway therealong.

Figure 2:
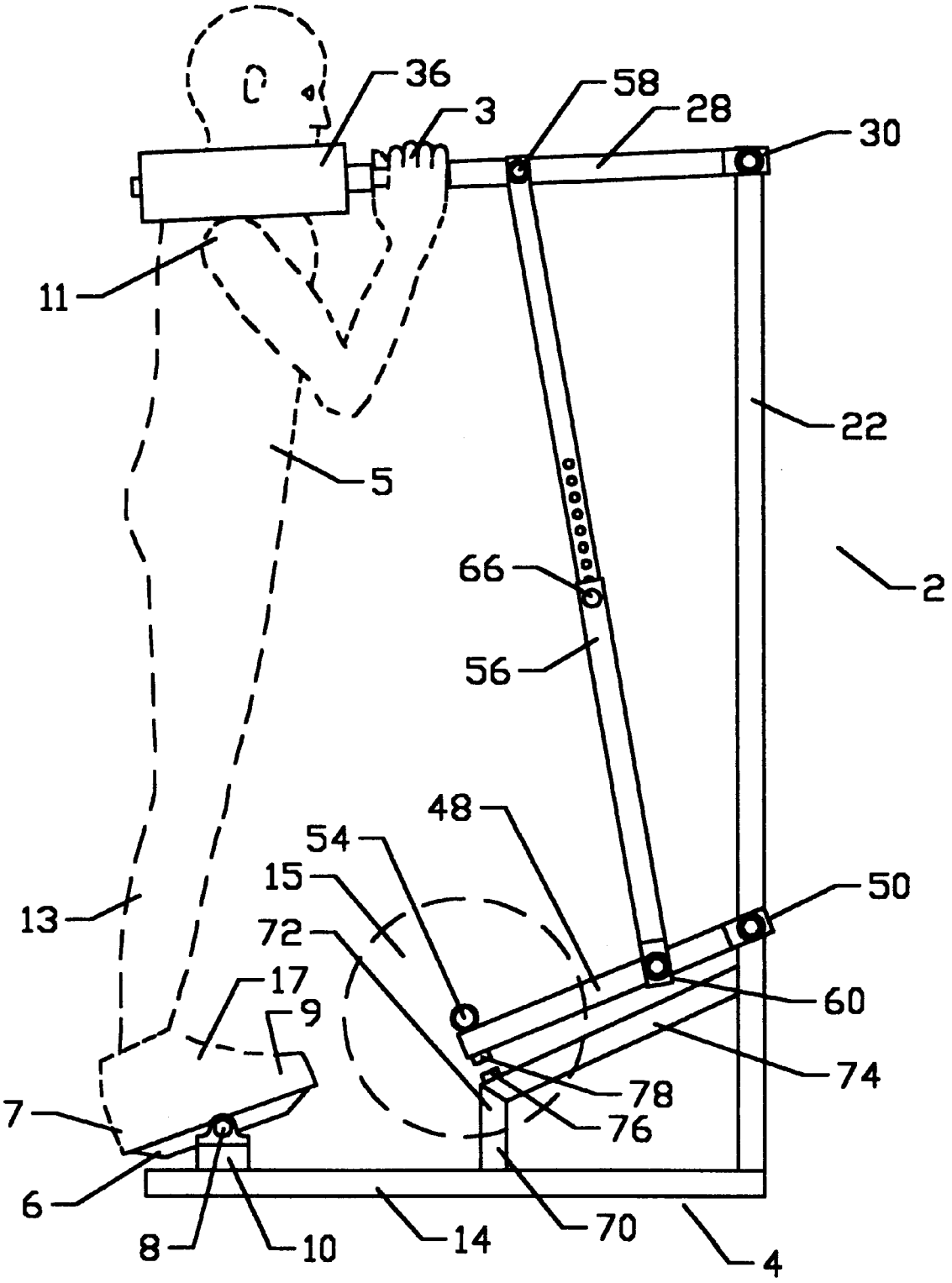
FIG. 2 is a front elevation of the preferred embodiment of the invention illustrated in operation by a user shown in dashed lines, the invention shown loaded with a free weight which is also shown by dashed lines.
Figure 3:
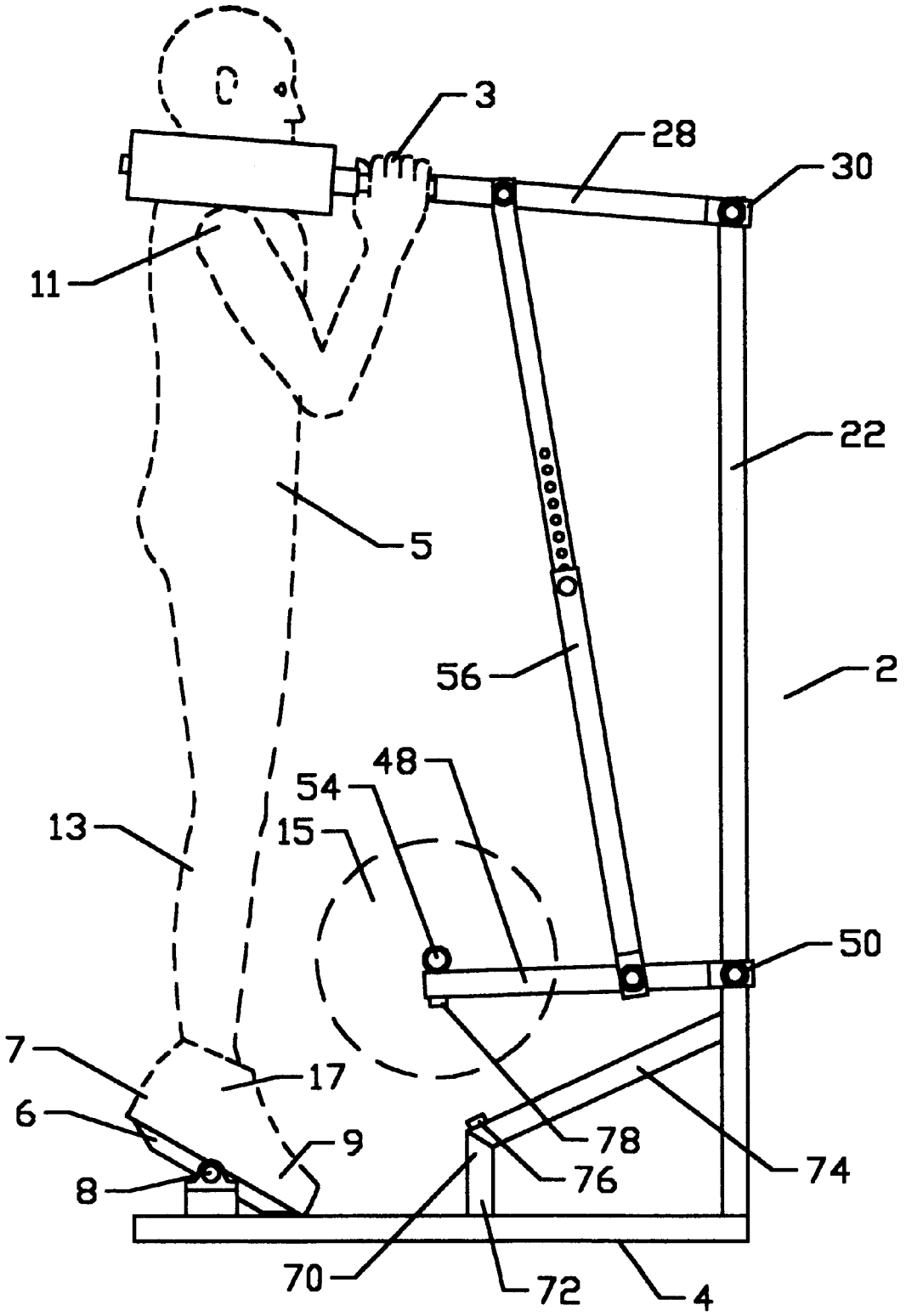
FIG. 3 is a front elevation of the preferred embodiment similar to FIG. 2 but with the invention in another operative position with the user shown with the user's heels raised above the user's toes.

FIGS. 2 and 3 show the invention 2 in stages of operation which may be achieved by a user 5 exercising the user's legs by use of invention 2. In FIG. 2 it is seen that user 5 is standing on foot platform 6 with the user's heels 7 positioned lower than the user's toes 9. The shoulder engagement bars 36, 38 are resting upon the shoulders 11 of the user 5. The user 5 grasps handles 44, 46 with the user's hands 3. In this position, the calf muscles 13 of the user 5 are extended. An Olympic-style free weight 15 of circular plate shape has been placed on weight suspending rod 54.

In FIG. 3, the user 5 is shown with the user's feet 17 rocked forward with toes 9 lower than heels 7. The user has flexed his calf muscles 13 into contraction, lifting lateral arm 28 and thereby weight arm 48 and weight 15 in the process.

Many variations of the illustrated structure will be apparent to those skilled in the art. It is therefore to be understood, that within the scope of the appended claims, the invention may be practiced other than as specifically described.

OPERATION OF THE INVENTION

It is to be understood that as the user moves his heels 7 from a position below his toes 9 through a position with heels 7 and toes 9 level, the moment of weight 15 on weight receiving rod 54 increases and subsequently decreases as the heels 7 rise above the toes 9 of user's feet 17 as foot platform 6 is rocked forward. Therefore, the resistance of weight 15 varies as the user 5 flexes his calves 13 from a weaker through a relatively stronger position to a relatively weaker position. The height of leg 72 and the height of third hinge 50 upon upright support member 22 are selected to allow weight receiving rod 54 to be disposed at a relatively low height to allow weight plates 15 to be added to weight receiving rod 54 without it becoming necessary to raise weights 15 above waist height. Hence, weight receiving rod 54 can be loaded without back strain or other danger of injury from raising weights overhead, for example.

Having described the invention, I claim:

1. Exercise apparatus for strengthening the leg muscles comprising a abase frame, a foot platform journally supported upon said base frame by an axle about which the foot platform is pivotable, the axle transversely disposed on said bas frame, an elongate upright bar mounted to said base frame spaced apart from said foot platform, a lateral arm hinged to said upright bar and pivotal within a substantially vertical plane, a weight arm hingedly mounted to said upright bar below and aligned with said lateral arm, the weight arm pivotal in a substantially vertical plane coincident with the plane of pivot of said lateral arm, at least one engagement bar extending from said lateral arm, a links member interconnecting said lateral arm and said weight arm along the respective lengths thereof, a rest support member is mounted to said base frame in underlying relationship to said weight arm, said weight arm rests upon said rest support member when said exercise apparatus is not in use, said rest support member comprising a vertical leg mounted to said base frame and a stabilizing bar interconnecting said vertical leg and said upright bar, whereby a user standing on said foot platform may reciprocatingly raise and lower said lateral arm while rocking forward and rearward on said foot platform.

2. The exercise apparatus of claim 1 wherein, a weight receiving bar is fixed to said weight arm and spaced therealong apart from said hinged mounting of said weight arm to said upright bar.

3. The exercise apparatus of claim 1 wherein, said at least one engagement bar comprises a pair of generally parallel, spaced apart padded bars between which a user may place his head to allow said padded bars to rest on the shoulders of the user, said padded bars substantially parallel to the axis of said lateral arm.

4. The exercise apparatus of claim 1 wherein, the rest support member supports said weight arm at a preselected height when said exercise apparatus is at rest.

5. The exercise apparatus of claim 2 wherein said weight receiving bar is a transverse cylindrical rod perpendicularly mounted to said weight arm, circular weight plates selectively suspended on said rod.

6. The exercise apparatus of claim 1 wherein said link member is selectively variable in length.

7. The exercise apparatus of claim 1 wherein, said foot platform is centrally supported on said axle.

8. The exercise apparatus of claim 1 wherein said base frame is generally rectangular having a first end and an opposing second end separated by opposing sides, said foot platform is mounted adjacent said first end of said frame, said elongate upright bar centered on said second end, said elongate upright bar having an upper end, said lateral arm hinged at said upper end of said upright bar, a weight receiving bar is fixed to said weight arm and spaced therealong apart from said hinged mounting of said weight arm to said upright bar, said at least one engagement bar comprises a pair of generally parallel spaced apart padded bars between which a user may place his head to allow said padded bars to rest on the shoulders of the user, said padded bars parallel to the axis of said lateral arm, the rest support member supports said weight arm at a preselected height when said exercise apparatus is a rest, said weight receiving bar is a transverse cylindrical rod perpendicularly mounted to said weight arm, circular weight plates selectively suspended on said rod, said link member is selectively variable in length.

9. Exercise apparatus for strengthening the calf muscles comprising a base frame having a first end and an opposing second end, a platform on which a user may stand pivotally mounted on said frame near the first end thereof, said platform rotatable about an axis transverse to said frame, said platform having a front edge and a rear edge, said axis of pivot of said platform is disposed approximately midway between said front edge and said rear edge, a first lateral arm supported above said base and movable within a vertical range, a second lateral arm supported above said base and movable within a vertical range, each of said first lateral arm and said second lateral arm pivotally mounted to an upright member mounted to said base, said upright member comprising an upstanding elongate bar, said first lateral arm and said second lateral arm pivotal in a generally coincident plane, said first lateral arm and said second lateral arm linked to move in concert by an interconnecting link member fixed by a first hinge to said first lateral member and fixed by a second hinge to said second lateral member, said second lateral arm comprising a horizontal weight receiving rod mounted perpendicularly therealong, said weight receiving rod sized to receive a circular weight plate thereon, said first lateral arm having a longitudinal axis and having a pair of spaced apart parallel engagement arms extending therefrom parallel to said longitudinal axis of said lateral arm, each of said engagement arms having a padded sleeve thereon, each of said spaced apart engagement arms having a hand grip extending coaxially therefrom, a rest support member mounted to said base in underlying relationship to said second lateral member, said second lateral member rests upon said rest support member when said exercise apparatus is not in use, said rest support member comprising a vertical leg mounted to said base and a stabilizing bar interconnecting said leg and said upright member.

10. The exercise apparatus of claim 9 wherein said interconnecting link is selectively variable in length to allow height adjustment of said engagement arms relative to said platform.

11. The exercise apparatus of claim 10 wherein, said interconnecting link is hinged to said first lateral arm generally midway between said pivotal mounting of said first lateral arm and said engagement arm thereof, said interconnecting link is hinged to said second lateral arm generally closer to said weight receiving rod than to said pivotal mounting of said second lateral arm to said upright bar.

12. Exercise apparatus for strengthening the calf muscles comprising, a base having a first end and an opposing second end, a foot platform pivotally mounted on said frame near the first end thereof, said foot platform rotatable about an axis transverse to said frame, a first literal arm vertically pivotable, a first lateral arm supported above said base, a second lateral arm supported above said base, the second lateral arm vertically pivotable, said first lateral arm and said second lateral arm linked to move in concert, said second lateral arm selectively receiving free weights therealong, a rest support member is mounted to said base in underlying relationship to said second lateral arm, said second lateral arm rests upon said rest support member when said exercise apparatus is not use, each of said first lateral arm and said second lateral arm pivotally mounted to an upright member mounted to said base, said rest support member comprising a vertical leg mounted to said base and a stabilizing bar interconnecting said leg and said upright member.

13. The exercise apparatus of claim 12 wherein said first lateral arm has a longitudinal axis and comprises a pair of spaced apart generally parallel engagement arms extending therefrom parallel to said longitudinal axis of said lateral arm, each of said spaced apart engagement arms having a linear hand grip extending coaxially therefrom.

14. The exercise apparatus of claim 13 wherein each of said engagement arms surrounded by a padded sleeve.

15. The exercise apparatus of claim 14 wherein said first lateral arm has a free end, said first lateral arm further comprises a transverse bar at the free end thereof, said engagement arms extending from said transverse bar toward said first end of said base, said hand grip of each of said engagement arms extending from said transverse bar toward said second end of said base.

16. The exercise apparatus of claim 1 wherein said lateral arm has longitudinal axis, said at least one engagement bar comprises a pair of spaced apart generally parallel engagement arms extending from said lateral arm generally parallel to said longitudinal; axis thereof, each of said spaced apart engagement arms having a linear hand grip extending coaxially therefrom, said hand grip of each of said engagement arms extending generally away from said foot platform.

17. The exercise apparatus of claim 16 wherein said lateral arm has a free end, said lateral arm further comprises a transverse bar at the free end thereof, said engagement arms extending from said transverse bar toward said foot platform, said hand grip of each engagement arms extending from said transverse bar away from said foot platform.

* * * * *

UNITED STATES PATENT AND TRADEMARK OFFICE

CERTIFICATE OF CORRECTION

PATENT NO. : 6,312,365 B1
DATED : November 6, 2001
INVENTOR(S) : Larry D. Koenig It is certified that error appears in the above-identified patent and that said Letters Patent is hereby corrected as shown below:

Title page,
Item [73], Assignee, delete "M'N Fitness Corp." and substitute therefor
-- JAM'N Fitness Corp. --.

Column 4,
Line 9, delete "abase" and substitute therefor -- a base --.
Line 12, delete "bas" and substitute therefor -- base --.
Line 24, delete "links" and substitute therefor -- link --.

Column 6,
Line 24, delete "literal" and substitute therefor -- lateral --.
Line 26, delete "a" and substitute therefor -- the --.
Line 36, after "before use" insert -- in --.

Column 7,
Line 2, after "longitudinal" delete the semicolon.

Signed and Sealed this

Sixth Day of August, 2002

*Attest:*

*Attesting Officer*

JAMES E. ROGAN
*Director of the United States Patent and Trademark Office*